US008411888B2

(12) United States Patent
Nielsen

(10) Patent No.: US 8,411,888 B2
(45) Date of Patent: Apr. 2, 2013

(54) HEARING AID AND A METHOD OF MANAGING A LOGGING DEVICE

(75) Inventor: Jakob Nielsen, Copenhagen (DK)

(73) Assignee: Widex A/S, Lynge (DK)

( * ) Notice: Subject to any disclaimer, the term of this patent is extended or adjusted under 35 U.S.C. 154(b) by 243 days.

(21) Appl. No.: 12/786,201

(22) Filed: May 24, 2010

(65) Prior Publication Data

US 2010/0232633 A1 Sep. 16, 2010

Related U.S. Application Data

(63) Continuation-in-part of application No. PCT/DK2007/000524, filed on Nov. 29, 2007.

(51) Int. Cl.
*H04R 25/00* (2006.01)

(52) U.S. Cl. ..... 381/317; 381/312; 381/314; 381/315; 381/323

(58) Field of Classification Search ..... 381/317, 381/312, 314
See application file for complete search history.

(56) References Cited

U.S. PATENT DOCUMENTS 5,687,241 A * 11/1997 Ludvigsen ..... 381/312
7,738,667 B2 * 6/2010 Bramslow et al. ..... 381/317
2004/0066944 A1 * 4/2004 Leenen et al. ..... 381/314
2004/0175008 A1 * 9/2004 Roeck et al. ..... 381/312
2004/0190737 A1 * 9/2004 Kuhnel et al. ..... 381/312
2004/0190739 A1 * 9/2004 Bachler et al. ..... 381/314
2007/0223754 A1 * 9/2007 Roeck et al. ..... 381/313
2008/0089523 A1 * 4/2008 Roeck ..... 381/23.1
2008/0260190 A1 * 10/2008 Kidmose ..... 381/314
2010/0027820 A1 * 2/2010 Kates ..... 381/312

FOREIGN PATENT DOCUMENTS

EP 1367857 A1 12/2003
WO 2007045276 A1 4/2007
WO WO 2007045276 A1 * 4/2007

* cited by examiner

*Primary Examiner* — David Warren
*Assistant Examiner* — Christina Russell
(74) *Attorney, Agent, or Firm* — Sughrue Mion, PLLC

(57) ABSTRACT

A hearing aid (1) and a method of managing data stored in a logging device in a hearing aid is devised. The method involves obtaining sets of data representing parameters such as the sound environment at a predetermined data acquisition rate and storing the data according to one of a plurality of a set of possible parameter sets in a histogram (15) is having room for a limited number of instances of each particular set of parameters. If the limit for a particular histogram bin is reached when an instance is stored in the histogram, the data acquisition rate is adjusted according to a specified scheme and the number of instances of every parameter set is reduced by a fixed factor. Acquired data in the histogram thus reflects the most recent sound environments experienced by the hearing aid user.

21 Claims, 4 Drawing Sheets

HEARING AID AND A METHOD OF MANAGING A LOGGING DEVICE

RELATED APPLICATIONS

The present application is a continuation-in-part of application No. PCT/DK2007000524, filed on Nov. 29, 2007, in Denmark and published as WO 2009068028 A1.

BACKGROUND OF THE INVENTION

1. Field of the Invention

This application relates to hearing aids. More specifically, it relates to digital hearing aids comprising means for logging parameters relating to the sound environment and the performance of the hearing aid during use.

2. Prior Art

Modern, digital hearing aids comprise sophisticated and complex signal processing units for processing and amplifying sound according to a prescription aimed at alleviating a hearing loss for a hearing impaired individual. In order to fine-tune the prescription settings, it is beneficial to gather statistical information about sound events from the listening environments in which a particular hearing aid is expected to function. This information may preferably be stored in the hearing aid, and a logging device including a non-volatile storage device is thus included in the hearing aid. In the following, this is denoted a hearing aid log. Parameter values are sampled at log sample intervals, and slowly an image of the daily use of the hearing aid, and the listening environments the user encounters during its use, is built up in the hearing aid log.

In this application, the term "log sample", unless otherwise noted, is referred to as the measuring and registration of parameter values selected to be recorded in the hearing aid log, over a length of time sufficient to derive at least some form of classification of the prevailing sound environment, e.g. a time interval in the order of minutes. The log sample period, also referred to as the a sound environment sample, is substantially larger than the input sample period, by which the analog voltage representing the sound pressure level is determined in the input A/D converter. State-of-the-art input A/D converters used for sound operate at rate of e.g. 16-96 kHz. The kind of hearing aids discussed in this application are preferably digital hearing aids, where a digital signal processor performs the conditioning and amplification of sounds to the user. This kind of hearing aids usually splits the signal up into a plurality of separate frequency bands using a corresponding plurality of band-pass filters. Each frequency band may then be amplified independently, and compression, noise reduction etc. may be performed on each frequency band.

A hearing aid logging device is described in WO-A1-2007045276. This device essentially logs two kinds of events, the time a user utilizes a specific program in the hearing aid, called usage logging, and a statistic logging of parameters characterizing the sound environment, called histogram logging.

The histogram logging works by accruing counts of events in respective histogram bins, and, whenever a bin is full, increasing the logging interval by a selected factor and reducing the counts in all the histogram bins by the inverse factor, i.e. effectively rebasing the counters and keeping track of the rebasing. This way of logging sound events results in a histogram representing an extended logging period.

Logging data may include, but is not limited to, data characterizing the listening environment, data regarding the user's operation of the hearing aid, i.e. changes in volume settings, changes between different programs in the hearing aid, and data regarding the internal operation of the hearing aid. The logging may also take combinations of different event types, like, the user switching to a particular program in a certain listening situation, into account.

The hearing aid logging device comprises a histogram representing all the possible parameter combinations of sound environments according to a predetermined definition, each parameter combination being represented by a specific bin in the histogram. The sound environment is sampled at specific intervals, and the closest corresponding bin is incremented, recording an occurrence of that particular sound environment in the hearing aid log.

The contents of the log are primarily used in fitting situations, where the hearing aid fitter extracts the data from a memory of the logging device of the hearing aid and interviews the hearing aid user to learn about the user's experience of using the hearing aid with the current settings in particular listening situations during the logging period. When comparing the log data with listening situations recalled by the user, the hearing aid user's memory may fail him or her regarding particular listening situations of short duration, e.g. listening events that may have been logged several weeks ago, and thus long forgotten by the user. This may generate some confusion for the fitter, and may be leading to the fitter altering the settings of the hearing aid unnecessarily. As a result, the hearing aid might be poorly optimized, the adjustments be a waste of time to the fitter, and thus a cause of discomfort to the user.

Instead of recording the sound itself in the hearing aid, a feat that would demand a nearly unlimited amount of memory in the hearing aid in order to store the sound, only a few properties of the sound is stored. Two main criteria determine the properties to be stored, namely measureability and the level of inherent information relevant to settings in the hearing aid.

Experience has shown that a record comprising three parameters strikes an adequate balance between memory economy and level of detail, a first parameter representing the noise level of the sound, a second parameter representing the modulation level of the sound, and a third parameter describing the slope of the noise spectrum in the sound.

The noise level is defined as the background noise level and is measured by averaging a 10% percentile envelope over the sound event sample period. The noise level gives valuable information to the signal processor in the hearing aid regarding the present average level of the noise in the signal, and the noise level may also provide a fitter with information regarding the noise level the user is experiencing during use of the hearing aid.

The modulation level is defined as the amount the useful signal is changing and is determined by measuring a 90% percentile envelope level and subtracting the measured 10% percentile envelope level from the 90% percentile envelope level averaged over the sound event sample period. The modulation level is mainly used by the hearing aid signal processor to determine the presence of speech in the signal, and it may also provide useful information to the fitter regarding the nature of the sound environments experienced by the user of the hearing aid.

The slope of the noise spectrum may be calculated by averaging the 10% percentile envelope level from each frequency band of the plurality of frequency bands and determining the slope of the resulting linear average over the frequency axis. This slope is computed once for each input sample and the result averaged over the sound event sample period. The slope of the noise spectrum allows the hearing aid signal processor to classify the nature of the noise in order to optimize the operation of noise reduction algorithms in the hearing aid for performing maximum noise reduction with minimum audible artefacts, and the fitter may derive useful information from knowledge of this noise spectrum slope in order to determine if certain types of noise are present in the experienced sound environments.

During use, the three parameters are continually measured, and the average levels of the measurements are stored in a buffer. At the sound event sample period the buffer contents are analyzed to classify the sample into a plurality among possible sound environments and a respective bin record in the hearing aid log, incremented, and the buffer reset, in this way, and, over time, a histogram representing the frequencies of the different, possible sound environments is built up in the hearing aid logging device.

The three parameters are collected in a vector representing the averaged sound environment during a predetermined period of time. The vector representing the sound environment is stored as a record for the purpose of subsequent analysis. The plurality of possible sound environments detectable by the system are prearranged as a number of initially empty bins in allocated memory, the collection of bins forming a histogram.

The log may contain one occurrence of one particular listening event, and fifteen occurrences of another, more frequently occurring event. If the hearing aid log, over the course of several weeks, has logged forty-two occurrences of the latter event, but only has allocated room for fifteen counts, the counter in respect of the latter event would have reached a limit and the balance between the different events in the log might become upset, as too much weight would be placed on the single event in relation to the more frequently occurring event. In the following, this is denoted the log overflow problem.

According to the prior art the log overflow problem is solved by decimating the histogram whenever one bin in the histogram reaches the maximum number of counts possible, e.g. fifteen occurrences of a particular sound event. This is done by dividing the contents of all the bins in the histogram by two and halving the sampling rate in order for subsequent samples to normalize the logging data.

However, this way of managing a hearing aid log has at least two undesired implications. The first implication is that particular sound environments logged many times during the initial part of the logging period, and not at all during later parts of the logging period, are kept in the histogram placing substantial weight on those sound environments that may really have lost interest. The second implication is that a strict time limit is imposed on the hearing aid log, either because the lowest possible sample rate is reached after successive decimations, or because the logged data becomes increasingly inaccurate and unreliable due to several occasions of biased logging as described in conjunction with the first implication.

SUMMARY OF THE INVENTION

A method of managing a hearing aid log in a way that emphasizes new data in favor of historical data, and permits the logging of sound environments during indefinite periods of time, is thus desired.

It is thus a feature of the invention to devise a hearing aid capable of logging data for an arbitrary period of time and in a manner better correlated to the hearing aid user's experience.

Non-volatile memory blocks are limited in terms of the number of write operations permitted. It is a further feature of the invention to devise a hearing aid capable of handling a detailed logging over an extended period of service and of storing the data in a non-volatile memory.

The hearing aid according to the invention, in a first aspect, comprises an input transducer for producing an input signal, a hearing aid processor for processing the input signal to produce an output signal, an output transducer responsive to said output signal, and a logging device having an analyzer, a timer, and a memory, said memory having a set of histogram counters in respect of a predefined set of sound environments, wherein said analyzer processes the input signal and classifies the sound event among the predefined set of sound environments, wherein said timer triggers the output of the classification of the sound event, wherein said memory receives the classification and increments a count in at least one of said histogram counters in respect of the sound environment, wherein said memory has an overflow detector for monitoring the histogram counters and for responding to the detection of an overflow event by rebasing all histogram counters through dividing the contents by a predetermined factor, and wherein said memory has means for analyzing the histogram counters for determining the width of a histogram profile and a timer decision logic for controlling said timer, which timer decision logic responds to signals from said analyzer in deciding the timer setting.

By realizing that the actual number of events present in the hearing aid log at any given time represents no useful information, whereas the relative magnitude between different logged events is much more informative, a suitable way to implement this knowledge is to apply the principle of exponential data averaging in the management of the hearing aid logging device.

The invention, in a second aspect, provides a method for managing data logging in a hearing aid, the method incorporating the steps of acquiring parameter data about the sound environment at a selected rate, arranging and storing the acquired data by counts in histogram counters in an allocated memory in the hearing aid, testing if any count exceeds a predetermined maximum number limit, and, in that case, reducing the number of all the counts proportionally by a predetermined factor, analyzing the histogram data for determining the width of a histogram profile, determining a new data acquisition sample rate based on the determined histogram width and altering the determined data acquisition sample rate accordingly.

The invention, in a third aspect, provides a method for managing data logging in a hearing aid, the method incorporating the steps of acquiring parameter data at a selected rate, arranging and storing the acquired data in a histogram in allocated memory in the hearing aid, testing if any occurrence of the stored data exceeds a predetermined maximum number limit, and, in that case, reducing the number of all the data occurrences proportionally by a predetermined factor, analyzing the histogram data, determining a new data acquisition sample rate based on the analysis and altering the selected sampling rate accordingly.

Further features and advantages appear from the dependent claims.

BRIEF DESCRIPTION OF THE DRAWINGS

The invention will now be described in further detail with reference to the drawings, where.

DETAILED DESCRIPTION OF THE INVENTION

Figure 1:
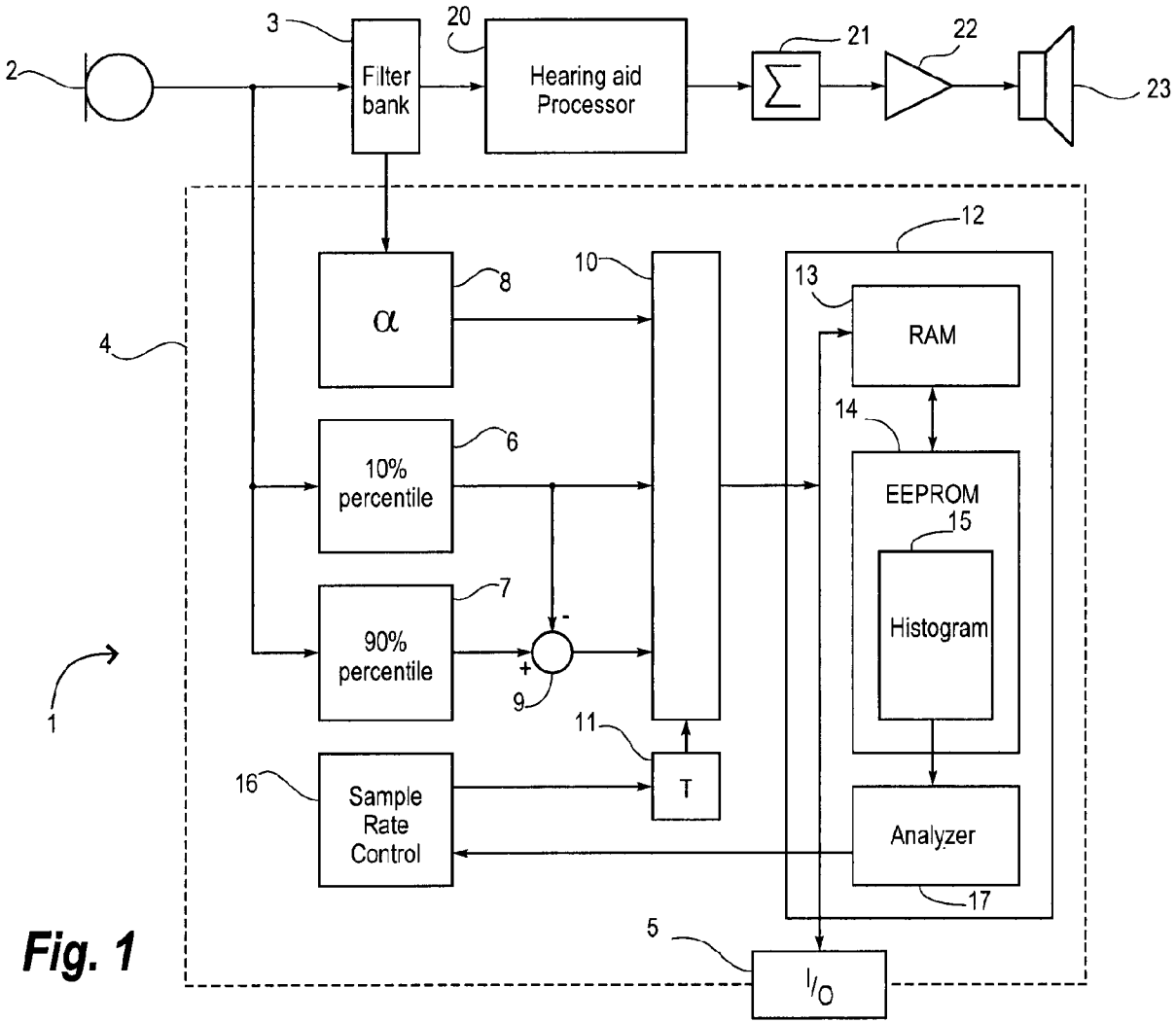
FIG. 1 is a schematic of a hearing aid with a logging device according to the invention.

FIG. 1 shows a block schematic of a hearing aid 1 with a logging device 4 according to the invention. The hearing aid 1 comprises an input microphone 2, a filter bank 3, a logging device 4, a hearing aid processor 20, a sigma-delta modulator 21, an output stage 22, and an acoustic output transducer 23. The logging device 4 comprises an input/output interface block 5, a 10% percentile block 6, a 90% percentile block 7, a noise spectrum slope indicator block 8, an intermediate summation block 9, a log data preparation block 10, a timer block 11, and a log storage block 12. The log storage block 12 comprises a volatile memory block 13, and a non-volatile memory block 14. The non-volatile memory block 14 is capable of storing at least one histogram 15. The non-volatile memory block 14 has an output connected to the input of an analyzer block 17. An output of the analyzer block 17 is connected to the input of a sample rate control block 16. The output of the sample rate control block 16 is connected to a control input of the timer block 11.

During the fitting of the hearing aid 1, the logging device 4 may be activated via the input/output interface 5. Acoustic signals are picked up by the hearing aid microphone 2 and converted into electrical signals. The output signal from the microphone 2 is split into two branches. One branch is fed to the filter bank 3 for further processing, and another branch is fed to the logging device 4. The output signal from the filter bank 3 is fed to the input of the hearing aid processor 20. The hearing aid processor 20 performs the sound processing according to a prescription for alleviating a hearing deficiency, and the output from the hearing aid processor 20 is fed into the sigma-delta modulator 21 and the output stage 22 for driving the acoustic output transducer 23.

In the logging device 4, the input signal is split into three branches for analysis. A first branch comprising the 10% percentile block 6 determines the overall noise level of the incoming signal. A second branch comprising the 90% percentile block 7 is used in conjunction with the intermediate summation point 9 and the 10% percentile block 6 to determine the modulation of the audio signal by taking the difference between the 90% percentile and the 10% percentile. A third branch comprising the noise spectrum slope indicator block 8 is used to determine the slope of the noise spectrum, i.e. whether the noise is dominated by high or low frequencies.

Taken together, the parameter set comprising the noise level parameter, the modulation level parameter, and the noise spectrum slope parameter denoted $\alpha$, is considered to represent an adequate characterization of the sound environment at a given instant without actually storing the sound itself. After analysis, the parameter set is presented to the log data preparation block 10, which performs normalization, quantizing and sorting of the three parameters in the set into one of a plurality of possible sound environments, represented by a multi-dimensional vector, ready for storage in the histogram 15. The timer block 11 is used to determine the log sampling period, i.e. how frequently the data preparation block 10 outputs the determined sound environment to the log storage block 12.

The log data preparation block 10 presents the determined sound environment to the volatile memory block 13 of the log storage block 12. The volatile memory block 13 stores the determined sound environment to be logged temporarily, and is also capable of storing the complete histogram 15 of all the logged sound environments to make it available to a readout through the input/output interface 5, in order that the contents of the log can be retrieved for examination. Whenever the volatile memory block 13 contains a predetermined number of logged sound environment events, the volatile memory block writes its contents in the histogram 15 to the non-volatile memory block 14. As the service life of the non-volatile memory block 14 is limited in terms of the number of write operations possible, this approach is preferred in order to prolong the useful service life of the components of the hearing aid logging device 4.

The analyzer 17 performs an analysis of the contents of the histogram 15 every time a bin in the histogram overflows and uses the derived information to control the sample rate control block 16. Depending on the contents of the histogram 15, the analyzer 17 provides the sample rate control block 16 with information regarding the optimum sample rate for logging the sound environment data. When a logging is first initiated via the input/output interface 5, the rate of the impulses used to trigger the log data preparation block 10 by the timer block 11, i.e. the sample rate, is set to the highest rate. The analyzer 17 may later decide to reduce the sample rate, for instance initiated by a bin overflow event of the histogram 15.

Considering a case where the histogram 15 may register up to sixteen occurrences of a particular sound environment, the logging may run at a sample rate of e.g. $1/16^{th}$ Hz, or, in other words, recording parameters of the sound environment in the log once every sixteen seconds. If the same environment is logged every sixteen seconds, the corresponding bin will be filled up after just sixteen log events, and the histogram will thus generate an overflow event after 256 seconds, equal to four minutes and sixteen seconds. After issuing the overflow event, the histogram will be rebased and the sample rate will be reduced, preferably to half the initial sample rate, and logging will thus proceed at a rate of $1/32^{th}$ Hz, or once every thirty-two seconds, logging new instances of sound environment events in the rebased histogram.

The input/output block 5 is used to initiate or stop the logging procedure, and is also used for readout of the stored data from the histogram 15 of the hearing aid logging device 4. During normal use, after initializing the hearing aid logging device 4, the input/output block 5 is inactive, the hearing aid logging device 4 carrying on logging sound environment events at regular intervals whenever the hearing aid 1 is turned on and in use.

Figure 2:
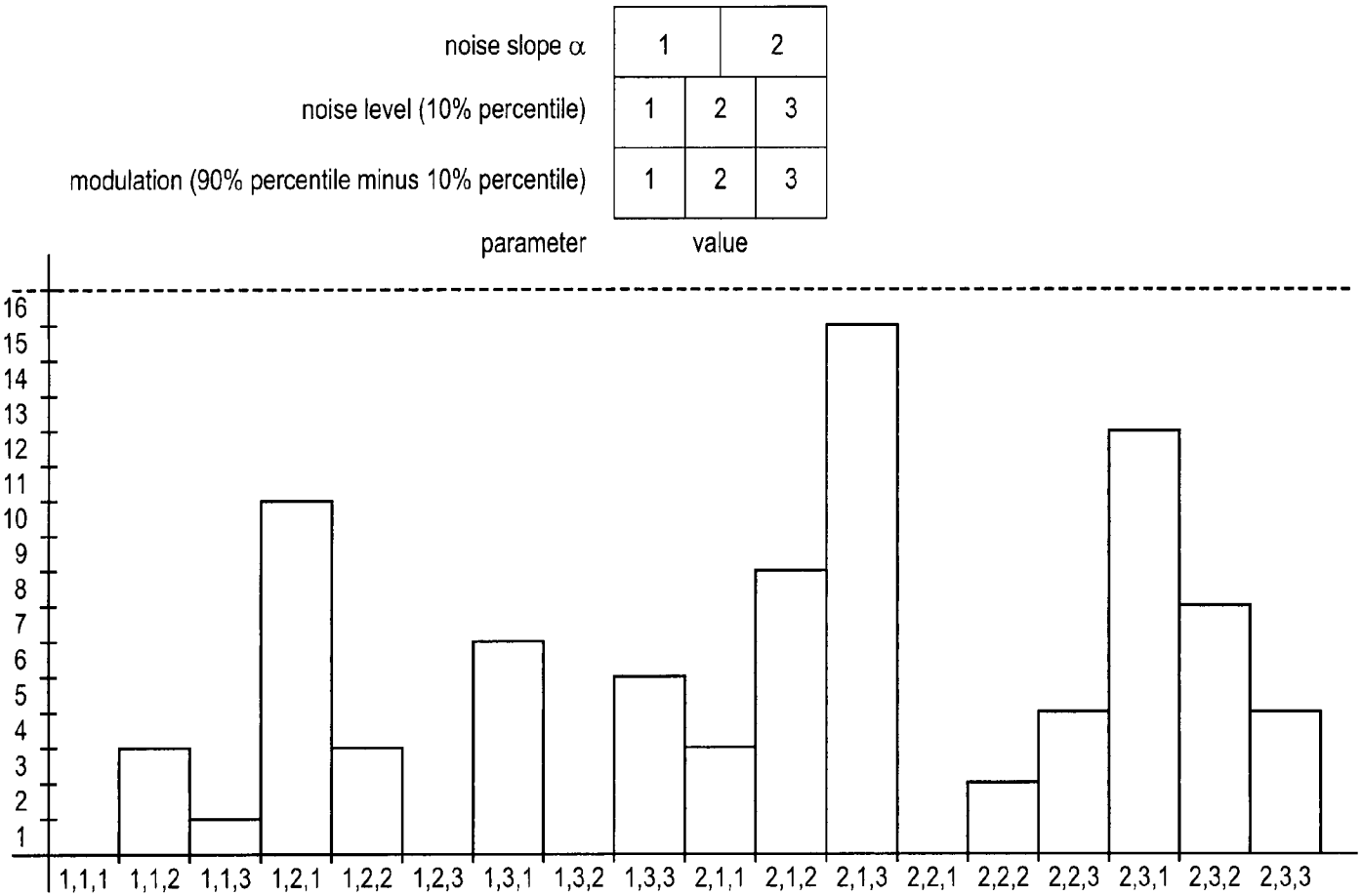
FIG. 2 is an example of a histogram with log data from the hearing aid shown in FIG. 1.

FIG. 2 is a graphic visualization of a hearing aid log histogram according to the example discussed previously. The log comprises three parameters of varying resolution as shown in the small table of FIG. 2. The parameters represent the three different data types that may be derived from the input signal of the hearing aid, two different values of the noise slope $\alpha$, three different values of the noise level, and three different values of modulation.

As each combination of parameter values is unique, the log has to account for 2*3*3=18 different parameter combinations, the occurrence of which may be logged in a histogram as shown in FIG. 2. Here the bins on the abscissa have been labeled in the format x,y,z, where x signifies noise slope, y signifies noise level, and z signifies modulation. The histogram reflects how often the different possible combinations of parameters have occurred within a given time frame. In this example, the resolutions of the three parameters have been greatly decreased in order to simplify visualization. Actual recorded parameters may have a much higher resolution, e.g. 256 different values per parameter.

As may be learned from FIG. 2, the occurrences of the sound environment instances may vary greatly from one parameter combination to another. The combination 1,2,3 and 1,3,2, for instance, have no occurrences in the histogram, and the combination 1,2,1 has ten occurrences logged within the given time frame. The histogram thus records the occurrences of each of the possible parameter combinations, and logs the results accordingly. The storage space allocated for the hearing aid log in this example is capable of storing up to sixteen occurrences of each possible parameter combination. In an actual histogram, the number of occurrences for each possible parameter combination may be increased arbitrarily.

When a log overflow event occurs, i.e. one histogram bin is overflowing, the whole histogram is rebased by dividing the number of records stored in each of the bins by a common factor, e.g. two or four, and the new number of records in each of the bins in the histogram are stored in the histogram. Numbers not divisible by the common factor are rounded down, thus the rebasing will map the single count in the bin 1,1,3 into a number of zero in the corresponding bin in the rebased histogram.

In this example, the combination 2,1,3 may be the most likely to cause the next log overflow, as this is the most frequently recorded combination in the histogram. If just two more occurrences of that particular parameter combination are recorded, the counter will overflow, and rebasing and subsequent sample rate reduction will take place.

One concern about this way of logging sound environments is that if the sample rate is repeatedly reduced to below a certain point, the recorded sound environments may be logged with so long intervals between them that they may appear arbitrarily in the resulting log histogram due to the fact that the character of the sound environment changes faster than the log is capable of recording it. Sound environments having a duration shorter than the logging period may thus slip past detection and subsequent logging even though they have some importance to the user of the hearing aid.

Another concern is that older data in the histogram keep having the same weight although they may have been recorded several weeks ago. If a log is in poor correlation with the user's memory—which has a natural tendency to fade with time—it may be difficult to interpret the data from the histogram in a meaningful way when the log is extracted from the hearing aid memory by the fitter.

When sufficient data are recorded in the hearing aid log—typically after a couple of hours—a second mode of logging is initiated. A log overflow in this second logging mode still initiates a rebasing of the hearing aid log, but the sample rate is kept at a fixed value. This has the effect that the importance of older data is reduced every time the log overflows, thus making new data recorded in the hearing aid log comparatively more prevalent.

Figure 3:
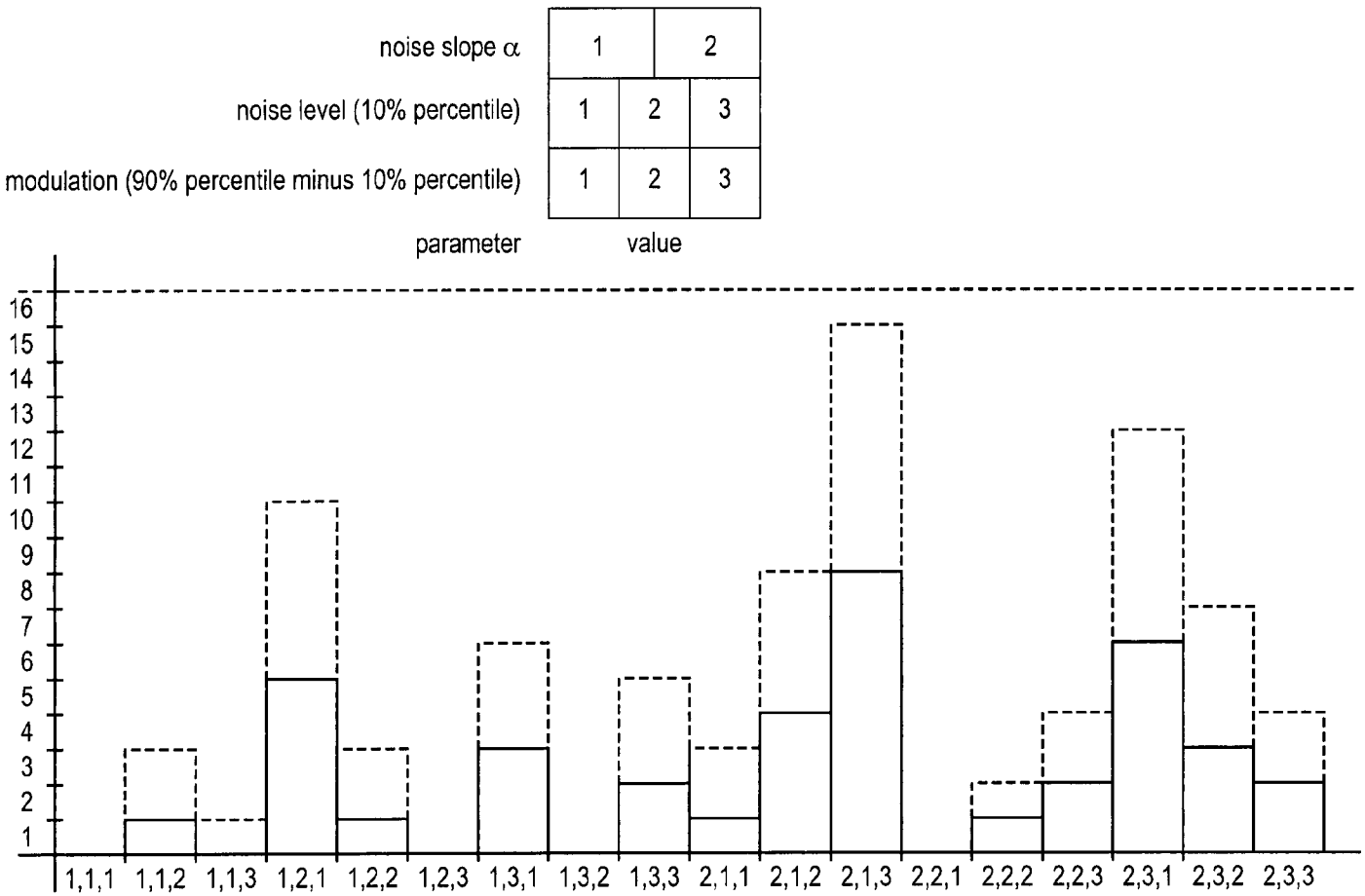
FIG. 3 is an example of the histogram with log data in FIG. 2 after a rebasing of the bin counts.

A visualization of the solution to the log overflow problem according to the invention is shown in FIG. 3, where a histogram similar to the histogram in FIG. 2 have had all the initial values of each bin (shown in dotted lines) replaced by rebased values (shown in solid lines) following a bin overflow. The histogram rebasing comprises halving all the bin values, although other rebasing schemes, such as dividing of the bin values by a factor three or four, may also be used. All even bin values are halved directly, and all uneven bin values are rounded down to the nearest even value, and then halved. The proportions of the bins relative to each other are thus maintained after a histogram rebasing.

If the histogram rebasing is followed by a halving of the sample rate, this step of the method is in concordance with a step in the method of the prior art. If, however, the sample rate is maintained at its former value after the histogram has been rebased, the proportions of the bins relative to each other are still maintained, but the relative weight of data collected before rebasing will be reduced, as compared to data collected after rebasing. After successive rebasing operations, the proportions of the bins relative to each other reflect the recent history in a more progressive manner dependent on the parameter combinations detected by the system. Successive rebasing events will further reduce the weight of the oldest data, in order that their weight will decay with time.

The information to be gathered from the rebased histogram is, at first, identical to the information available before the rebasing, if round-off errors introduced by the rebasing are disregarded. The relative magnitude of the records in each bin in the histogram is essentially the same, the parameter combination 2,1,3 still has the most common occurrence, and the number of occurrences of the other parameter combinations have the same relationship to the parameter combination 2,1,3 as before the rebasing.

In certain cases, a large variation in the recorded sound environments may lead to inaccuracies in the log data. For instance, if the user experiences many different sound environments during a logging period, many of the bins in the log may be filled at almost the same rate. However, if the user only experiences a few different sound environments during the same logging period, only one or two bins may be filled, and the other bins be left empty. In the first case, a lot of samples of different sound environments will have occurred—and thus a longer logging period will have elapsed—before one of the bins will overflow. In the second case, a bin will overflow much sooner than in the first case assuming the sampling rate being the same in both cases.

In order to get a picture of the variation in the sound environments experienced by the user during the logging period, the approach according to the invention is to place more importance towards more recent events recorded in the log. This weighing of recorded events may be carried out by altering the histogram management in a way that is explained in more detail in the following.

Whenever a parameter combination bin in the histogram is full, and the histogram thus is pending a rebasing as described earlier, two additional operations are performed. The first operation is to scan the histogram for bins that are more than three-quarters full. In a digital system, this may be done very easily by testing the most significant bit and subsequently the next-most significant bit of the bin count of each bin. If both bits are set, that particular bin is more than three-quarters full, and the identity of the bin is indicated. The second operation is to store this information separately from the histogram itself, thus requiring allocating storage room for the identities of the bins that are more than three-quarters full.

When information about which bins are more than three-quarters full, hereinafter denoted the background information, is stored, a statistical profile analysis of the histogram may be carried out based on that information. This analysis yields information about how fast the sound environment changes, and is used for determining the sample rate for collecting sound environment data.

A narrow profile means that one or a few sound environment types are predominant in the histogram, and the sound environment is relatively homogenous over time. Memory write events may then be saved by decreasing the sample rate. A wide profile means that the sound environment is relatively heterogenous over time. A more precise impression of the sound environments experienced may thus be obtained by increasing the sample rate. After adjusting the sample rate based on this analysis, the histogram may be decimated as described earlier.

A hearing aid fitter may gather useful information from the histogram and the stored background information when analyzing a readout from the hearing aid log. The histogram may provide information about the sound environment, such as the level and character of the background noise level and the presence of speech signals as a percentage of the overall signal. The stored background information may provide information about the variance of the different sound environments experienced by the user during the entire logging period.

The sound environments experienced by the hearing aid user are usually logged during a period spanning from a few weeks to several months depending on an initial expectation from the fitter regarding the sound environments. As logging only takes place while the hearing aid is turned on, the operational time information is recorded by an on-time counter present in the hearing aid. This on-time counter is used in conjunction with the logging data in order to establish a picture of the sound environments experienced by the hearing aid user during the logging period.

The logging procedure in the hearing aid runs concurrently with the actual audio processing performed by the hearing aid. In the preferred embodiment, the hearing aid log records the noise level, the modulation level, and the slope of the noise spectrum together with information about how the hearing aid is operated, e.g. what programs are preferred, what level the volume control is set to etc., but other parameters may be recorded as well. Examples are: the occurrence of a sound exceeding an upper comfort level for more than two seconds, activity and performance of a feedback cancellation system, a telecoil, or a direct audio input, and so on. Due to the limited storage space available in the memory present in the hearing aid, some form of data reduction may be performed prior to storing data in the hearing aid log.

The sample rate at which the hearing aid log performs the logging is preferably adjustable. Experience has shown a sample rate of between one and fifteen minutes to be satisfactory when balancing the desired level of detail of the logged data against considerations regarding memory economy. The sample rate may be set initially by the hearing aid fitter initiating a logging, but may also be adjusted automatically by the hearing aid processor, through performing a simple analysis of the data of the histogram and the background information.

If a rebasing operation is pending in the histogram and the background information indicates a large spread in the histogram data, many different sound environments are encountered. The sample rate may then beneficially be increased to ensure that a particular sound environment is logged before it changes character because the sound environment is likely to change within a sampling period.

If, on the other hand, a rebasing operation is pending in the histogram and the background information indicates a small spread in the histogram data, only a few different sound environments are encountered. The sample rate may then beneficially be decreased in order to conserve memory because the sound environment is unlikely to change within a sampling period.

The hearing aid log thus provides the hearing aid fitter with quantitative information regarding the qualitative working conditions of the hearing aid as recorded during a specific period. This information may be used together with an interview with the hearing aid user in order to clarify possible problems regarding adjustments of the hearing aid prescription. By knowing the predominant sound environments a hearing aid user has experienced during a period of wearing and using the hearing aid, the hearing aid fitter may devise a better fitting of the hearing aid.

If, for instance, a hearing aid user complains about difficulties understanding speech under certain listening conditions, but has difficulties describing the particular situations when and where the difficulties occur, the hearing aid fitter may then extract and analyze the hearing aid log in order to determine the sound environments the user has experienced while wearing and using the hearing aid, and may take action to adjust the hearing aid fitting accordingly based on the information derived from the hearing aid log and the hearing aid fitter's own experience.

In a general example, a hearing aid user may complain about having difficulties understanding speech in certain types of noise, but he or she cannot describe the character of the noise, nor remember the exact situations in which the difficulties are experienced, perhaps due to a lack of a suitable audiological vocabulary or a failing memory.

The hearing aid fitter then initiates a logging of the sound environments by activating the hearing aid log using a dedicated command in the hearing aid fitting software, and the hearing aid user will revert to his normal everyday activities. When the hearing aid user returns after a couple of weeks the hearing aid log might e.g. reveal that situations with a fair amount of high-frequency noise or hiss are predominant. The fitter would then take advantage of the knowledge about the exact nature of the experienced sound environments stored in the log, and might e.g. adjust the hearing aid fitting in order to make speech dominate over the higher frequencies by adjusting the frequency response, the compressor settings, and other adjustable parameters in the hearing aid, in order to alleviate the hearing aid user's difficulty understanding speech in the particular sound environments that particular hearing aid user is experiencing.

The appearance of a particular histogram readout at an arbitrary time is dependent on the sample rate. Other means for controlling the sample rate may involve a more elaborate, statistical analysis of the contents of the histogram than just counting the contents of the individual bins. The reason that controlling the sample rate is important is explained in more detail in the following.

If a hearing aid user experiences a lot of different sound environments during a logging period, the resulting histogram has a rather wide statistical profile, as many of the bins appear to be equally filled. Such a case may be identified by applying appropriate statistical analysis to the histogram. In this case, it is beneficial to increase the sample rate to gain more samples of the sound environment during a similar logging period. In this way, a more detailed picture of the types of sound environments the user actually experiences will emerge from the resulting histogram.

If, however, a hearing aid user only experiences a few different sound environments during a logging period, the resulting histogram has a rather narrow statistical profile, as only a few bins are full whenever a histogram rebasing occurs. Such a case may also be identified by applying appropriate statistical analysis to the histogram. In this case, it is beneficial to decrease the sample rate to gain fewer samples of the sound environment during a similar logging period. In this way, a less detailed picture of the types of sound environments the user actually experiences will emerge from the resulting histogram.

Figure 4:
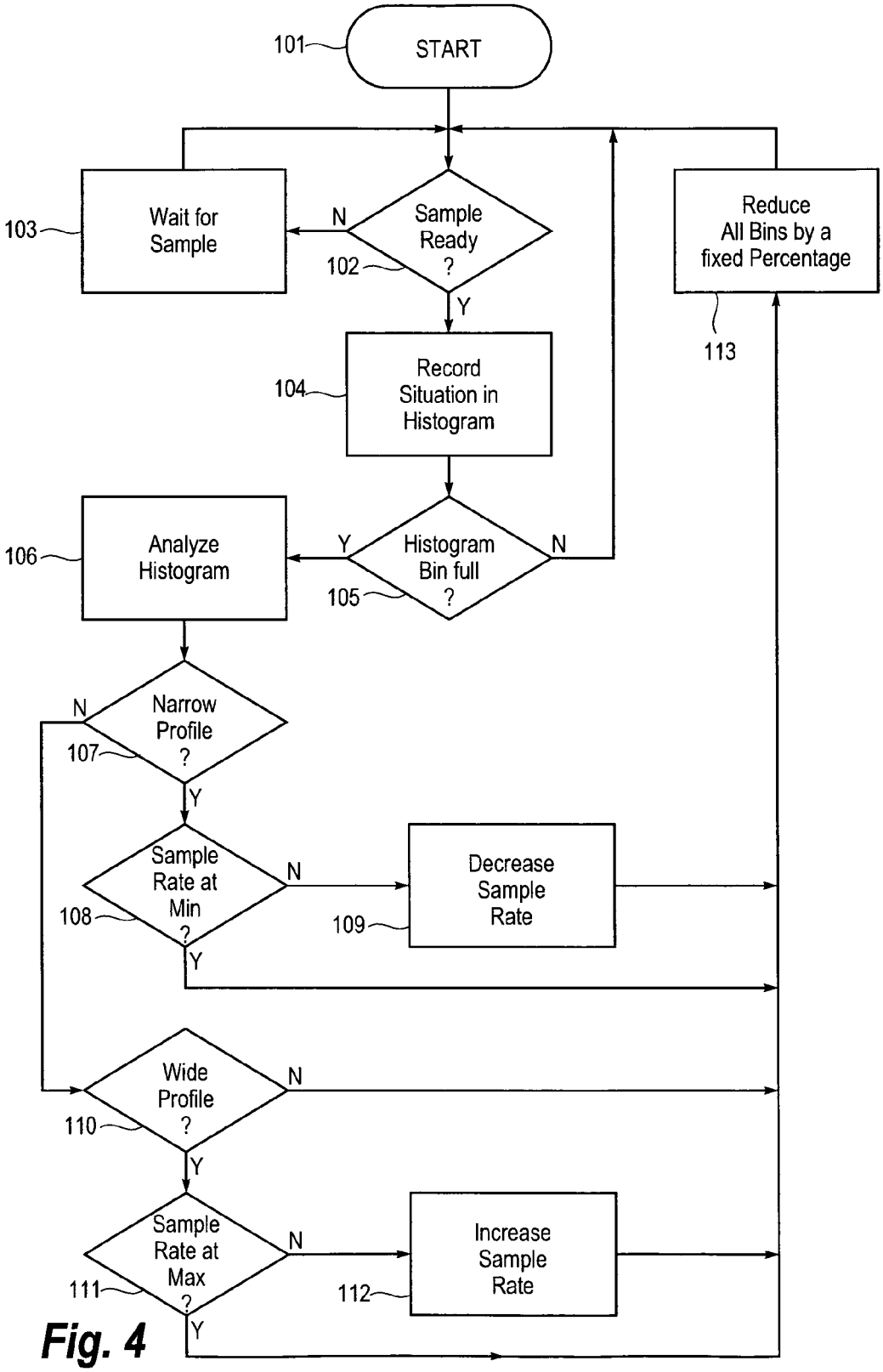
FIG. 4 is flowchart of an algorithm for performing the method of the invention.

A flowchart of an algorithm describing the method of managing data acquisition and storage according to the invention is shown in FIG. 4. The purpose of the algorithm is to account for the instances when a histogram bin is full, rebase the histogram and adjust the data acquisition rate, here denoted the sample rate, accordingly.

The algorithm may be seen as divided into two parts. The first part, incorporating the steps 101, 102, 103, 104, and 105, takes care of the data acquisition of sound environment events, and the second part, incorporating the steps 106, 107, 108, 109, 110, 111, 112, and 113, handles the histogram analysis, sample rate adjustment and histogram bin rebasing. These tasks will be explained in more detail in the following.

The algorithm starts in step 101, where variables are set and storage is allocated for the histogram. The input is checked for a new sound environment sample in step 102.

If no new sample is present, a wait loop is entered by branching off into step 103. Whenever a new sound environment sample is ready, the sample is recorded in the histogram by branching off into step 104. After recording the sample in step 104, a test is performed in step 105 in order to determine if the histogram bin where the sample was stored in step 104 is full. If that is not the case, the logging continues, and the algorithm loops back to step 102 in order to wait for the next sample.

If, however, the histogram bin where the sample was stored in step 104 was full, the algorithm branches out into the second part of the algorithm via step 106, where a statistical analysis of the histogram is carried out. Among the results of the analysis are a histogram profile analysis, i.e. an examination of the histogram in order to determine if one of three conditions are present.

The first condition checked is the so-called "narrow-profile" case, checked in step 107. A narrow profile in a histogram indicates that only a few bins have reached their largest value when a bin in the histogram is full. This indicates that only a few sound environments prevail in the log. In other words, the sound environments experienced are relatively constant over time. In this case, the sample rate may advantageously be decreased, since many of the sound environment events recorded in the histogram will be essentially the same.

If a narrow profile is absent, the algorithm jumps readily into step 110. If a narrow profile is present, the algorithm branches out into step 108 in order to check whether the current sample rate is the lowest possible sample rate. If this is not the case, the algorithm branches out into step 109, where the sample rate is decreased, and the algorithm loops back through step 113, where all bins are rebased as described previously, and into step 102 in order to wait for the next sample. If, however, the sample rate is the lowest possible sample rate, the algorithm loops back through step 113, where all bins are rebased as described previously, and into step 102 in order to wait for the next sample.

The second condition checked is the so-called "wide-profile" case, checked in step 110. A wide profile in a histogram indicates that many bins have reached close to their largest value when a bin in the histogram is full. This indicates that a lot of different sound environments have been registered in the log, in other words, the sounds experienced have changed a lot over time. In this case, the sample rate may advantageously be increased, since many different sound environment events are recorded in the histogram.

If a wide profile is absent from the analyzed histogram, the algorithm branches out from step 110 and loops back through step 113, where all bins are rebased as described earlier, and into step 102 in order to wait for the next sample.

If a wide profile is present, the algorithm branches out to step 111 in order to check whether the current sample rate is the highest possible sample rate. If this is not the case, the algorithm branches out to step 112, where the sample rate is increased, and the algorithm loops back through step 113 and into step 102 in order to wait for the next sample.

If, however, the sample rate already is at its minimum value, the algorithm loops back through step 113 and into step 102 in order to wait for the next sample. This is, in fact, the third condition, i.e. the histogram profile is undetermined, and the sample rate is thus left unchanged.

Whenever a readout from the hearing aid log is performed by the hearing aid fitter, the relative occurrences of the possible parameter combinations in the hearing aid log remain true to the sound environments actually experienced by the hearing aid user during the logging period, even though one or more of the parameter combinations have occurred more times than the log can actually contain. The hearing aid log thus provides the hearing aid fitter with a powerful tool for fine-tuning the listening programs available to the hearing aid user.

I claim:

1. A hearing aid comprising:

an input transducer for producing an input signal representing a sound event;

a hearing aid processor for processing the input signal to produce an output signal;

an output transducer responsive to said output signal; and a logging device having:

a classification means processing the input signal and classifying the sound event among a predefined set of sound environments;

a timer triggering the classification means to output the classification of the sound event;

a memory having a set of histogram counters corresponding to said predefined set of sound environments, wherein in at least one of said counters is incremented in respect of the sound environment depending on the output from the classification means;

an analyzer monitoring the counters, and upon detection of counter overflow:

analyzing values of said counters in order to evaluate the sound environment homogenousity over time;

rebasing all histogram counters by dividing the contents by a predetermined factor; and adjusting a triggering rate of the timer in dependence of the sound environment homogenousity evaluation.

2. The hearing aid according to claim 1, wherein said has means for analyzing the histogram counters and for setting, in the event of a narrow histogram profile, an increased timer period.

3. The hearing aid according to claim 1, wherein said has means for analyzing the histogram counters and for setting, in the event of a wide histogram profile, a decreased timer period.

4. The hearing aid according to claim 1, wherein said memory comprises a volatile memory block for storing data and a non-volatile memory block for intermittently recording the data from the volatile memory block.

5. The hearing aid according to claim 1, wherein said histogram counters represent sound environments defined by respective sets of characteristic parameters.

6. The hearing aid according to claim 1, wherein said analyzer comprises means for determining one among a plurality of possible histogram profiles and means for producing a plurality of possible control signals based on the determined histogram profile.

7. A method for managing data logging in a hearing aid, the method incorporating the steps of acquiring parameter data about the sound environment at a selected rate, arranging and storing the acquired data by counts in histogram counters in an allocated memory in the hearing aid, testing if any count exceeds a predetermined maximum number limit, and, in that case, reducing the number of all the counts proportionally by a predetermined factor, analyzing the histogram data for determining the width of a histogram profile, determining a new data acquisition sample rate based on the determined histogram width and altering the determined data acquisition sample rate accordingly.

8. The method according to claim 7, wherein at least some of the acquired parameter data represent sound environments.

9. The method according to claim 7, wherein said the predetermined factor is recorded in said allocated memory.

10. The method according to claim 7, wherein the data acquisition sample rate is selected from a list of predetermined data acquisition sample rates.

11. The method according to claim 7, wherein the step of analyzing the histogram data incorporates a step of decreasing the data acquisition sample rate if the profile is recognized as a narrow profile.

12. The method according to claim 7, wherein the step of analyzing the histogram data incorporates a step of increasing the data acquisition sample rate if the profile is recognized as a wide profile.

13. The method according to claim 7, wherein the step of determining the width of a histogram profile incorporates a step of calculating a set of statistical parameters.

14. The method according to claim 7, wherein the parameter data of the sound environment comprise at least one slope of the sound spectrum of input signal data;

a modulation of input signal data; and a sound pressure level of the noise of input signal data.

15. The method according to claim 7, wherein said strep of analyzing the histogram comprises analyzing count values in order to evaluate the sound environment homogeneity over time.

16. A method for managing data logging in a hearing aid, the method incorporating the steps of acquiring parameter data at a selected rate, arranging and storing the acquired data in a histogram in allocated memory in the hearing aid, testing if any occurrence of the stored data exceeds a predetermined maximum number limit, and, in that case, reducing the number of all the data occurrences proportionally by a predetermined factor, analyzing the histogram data, determining a new data acquisition sample rate based on the analysis and altering the selected sampling rate accordingly, wherein said step of analyzing the histogram comprises analyzing count values in order to evaluate the sound environment homogeneity over time.

17. The method according to claim 16, characterized in that at least some of the acquired parameter data represent sound environments.

18. The method according to claim 16, characterized in that the predetermined factor is recorded in the allocated memory.

19. The method according to claim 16, characterized in that the new data acquisition sample rate is selected from a list of predetermined sample intervals.

20. The method according to claim 16 characterized in that the step of analyzing the histogram data incorporates the step of decreasing the data acquisition sample rate if the profile is recognized as a narrow profile.

21. A method for managing data logging in a hearing aid, the method incorporating the steps of acquiring parameter data at a selected rate, arranging and storing the acquired data in a histogram in allocated memory in the hearing aid, testing if any occurrence of the stored data exceeds a predetermined maximum number limit, and, in that case, reducing the number of all the data occurrences proportionally by a predetermined factor, analyzing the histogram data, determining a new data acquisition sample rate based on the analysis and altering the selected sampling rate accordingly, characterized in that the step of analyzing the histogram data incorporates the step of determining the width of a histogram profile.

* * * * *